United States Patent [19]

MacDonald

[11] 4,340,119

[45] Jul. 20, 1982

[54] MOTOR GRADER WITH BAR LINKAGE BLADE POSITIONING APPARATUS

[75] Inventor: Jack G. MacDonald, Goderich, Canada

[73] Assignee: Champion Road Machinery Limited, Goderich, Canada

[21] Appl. No.: 139,249

[22] Filed: Apr. 11, 1980

Related U.S. Application Data

[63] Continuation-in-part of Ser. No. 912,559, May 6, 1978, abandoned.

[51] Int. Cl.[2] ..... E02F 3/76

[52] U.S. Cl. ..... 172/789; 172/743; 172/797

[58] Field of Search ..... 172/742, 743, 789, 791, 172/792, 793, 795, 796, 797; 403/93

[56] References Cited

U.S. PATENT DOCUMENTS

| | | | |
|---|---|---|---|
| 179,065 | 6/1876 | Schlessman | 403/93 |
| 2,194,875 | 3/1940 | Sowell | 172/795 |
| 2,655,743 | 10/1953 | Ross | 172/793 |
| 3,517,753 | 6/1970 | Tift | 172/795 |
| 3,739,861 | 6/1973 | Johnson et al. | 172/793 |
| 3,986,563 | 10/1976 | Stubben | 172/793 |
| 4,020,908 | 5/1977 | Kobayasi et al. | 172/742 |

FOREIGN PATENT DOCUMENTS

| | | | |
|---|---|---|---|
| 1484689 | 4/1969 | Fed. Rep. of Germany | 172/789 |
| 1101649 | 1/1968 | United Kingdom | 172/789 |
| 2022173 | 12/1979 | United Kingdom | 172/796 |

*Primary Examiner*—Richard T. Stouffer

[57] ABSTRACT

The specification discloses a new blade positioning apparatus for use in motor graders, that provides improved visibility and allows the operator to easily control the elevation, transverse inclination, and position of the scraper blade beneath the machine. The device comprises a transverse "W" shaped beam pivotally mounted to the upper surface of the support frame of the grader to allow partial rotation of the beam about the main frame. A link member passes beneath the frame of the grader and is secured to the beam member, such that the beam and link members encircle the frame. The link member cooperates with a releasable lock mechanism for securing the beam member at selected adjusted positions relative to the support frame. According to a preferred aspect of the invention, the lock mechanism includes a bar lock pivoted at one end beneath the frame of the grader and is received in tapered notches provided in the link. An over-center locking linkage arrangement is provided for moving the free end of the bar lock from a locked position to a free position for adjusting of the beam relative to the frame.

8 Claims, 13 Drawing Figures

MOTOR GRADER WITH BAR LINKAGE BLADE POSITIONING APPARATUS

This is a continuation-in-part of application Ser. No. 912,559, J. G. MacDonald, filed May 6, 1978, now abandoned.

FIELD OF THE INVENTION

This invention relates to a blade positioning apparatus for motor graders in which the blade may be positioned to either side of the frame of the grader for road grading as well as inclining the blade for any desired steepness of bank cutting.

BACKGROUND OF THE INVENTION

In the past, a number of blade positioning devices have been proposed for use in motor graders. One such device used a beam member saddling the main frame of the grader and rigidly attached to it. Two hydraulic lift cylinders laterally spaced of the main frame were supported by the beam member and the other end of the cylinders attached to a draw bar swivellably fastened to the forward portion of the grader. The device used a hydraulic shift cylinder fastened to the draw bar and the main frame allowing the draw bar to be positioned either side of the grader. The lift cylinder could then be adjusted to control the elevation and inclination of the scraper blade. However, because this transverse beam was rigidly attached to the main frame of the grader, the degree of inclination of the blade was limited to interference of the cylinders with the main frame.

This particular problem of interference was overcome by mounting the transverse beam on a large ring bearing surrounding the frame of the grader. This arrangement allowed the beam to rotate relative to the mainframe of the grader and lock at various adjusted positions. The apparatus, however, introduced new problems in that this large ring bearing was expensive to manufacture and vulnerable to wear. Other problems also occurred with shearing of the locking pin used to maintain the adjusted position of the beam; however, this problem was overcome by using several lock pins. As the wear of the ring bearing increased, the performance of the grader decreased. Repair of the ring bearing was difficult to accomplish as well as expensive.

Operator visibility and flexibility of the blade positioning system are extremely important and designs have often maximized one of these functions to the detriment of the others. German Offenlegungschrift No. 1,484,689 discloses a one-piece construction blade positioning apparatus, which surrounds the frame and is pivoted to the upper surface thereof with a lock pin arrangement located beneath the frame. However, the portion of the structure immediately adjacent and to either side; the pivot point arcs upwardly and outwardly thereby seriously impeding the operator's visibility once the structure has been rotated to allow the blade to be positioned for bank sloping. In its maximum position, the area immediately above the center of the frame has become quite congested, thereby seriously impeding the operator's visibility. It is desirable in blade positioning systems to have the area above the frame of the grader as free from obstruction as possible; however, this requirement has not been satisfied by prior art rigid systems.

Other mechanism include the use of two pivoted crank arms secured to the opposite vertical faces of the main frame and joined by a link member. These pivot arms also support the hydraulic lift cylinders and the arrangement functions essentially as a four bar linkage. Although these systems are an improvement over the large ring bearing method described above, they still suffer from many of the same problems, due to the relatively large number of moving parts and the required tolerances associated with each pivot point.

The main problems in prior art structures are the high cost to manufacture and maintain the vulnerability of the apparatus to wear, because of the relatively large number of moving parts and the adverse effect they have on visibility looking along the upper frame of the grader.

As wear in the blade positioning apparatus increases, not only the static forces but dynamic forces must also be considered. The inertia forces are considerable with such large devices and, therefore, the rate of wear accelerates as wear increases. The loads exerted on the blade positioning device are high and often have impact loads of much higher magnitude due to a sudden change in composition of the ground being graded. These high loads and higher impact loads demand a system that is inherently strong and also easy to repair.

Another problem common to these prior art systems is the lock mechanism, which normally includes a lock pin for engagement in an aperture provided in one compound of the blade positioning structure. Due to the high loads that can be encountered and due to wear, damage of the pin may result which can cause difficulties in releasing and locking of this mechanism. Furthermore, if the blade positioning structure remains in one position for an extended period of time, corrosion may result seizing the pin in place. The present invention includes a unique lock mechanism for overcoming a number of these problems.

SUMMARY OF THE INVENTION

According to the present invention, in a motor grader having a rectangular in cross-section support frame, a draw bar swivelled thereto adjacent its forward end and a scraper blade rotatably supported from said draw bar, an improved rigid blade positioning device for increasing the unobstructed view of the area above the frame of the grader and to the exterior of the blade positioning device is disclosed. The blade positioning device allows the blade to be positioned to either side of the grade at various angles from horizontal to approximately vertical and comprises a beam member transversing and centered on the top of the support frame and pivoted about its middle to rotate about an axis to adjusted positions. The axis extends in the fore and aft direction of the grader and is secured to the upper surface of the support frame. A link member is removably fastened to the beam at points spaced each side of the support frame, such that the link in combination with the beam encircles the frame. A releasable lock is secured adjacent the lower surface of the grader frame for holding the beam in selected adjusted positions and allow the beam member to be rotated to various adjusted positions when the lock means is released. The combination of the beam and the link member provides a rigid structure for universally supporting outwardly to each side of the support frame a pair of double acting hydraulically actuated lift cylinders. Each lift cylinder extends downwardly to, and universally connected to, the draw bar and a double acting hydraulically actuated shift cylinder universally connecting the beam member and the draw bar is provided for moving the aft portion of the draw bar to either side of the grader frame, when the lock means is engaged and for partial rotation of the beam member to selected adjusted positions when the lock mechanism is released. The beam member is symmetrical and has to either side of the pivot axis a central arm, an intermediate arm and a distal arm, with the central arm extending outwardly and upwardly from the pivot axis at a sufficient angle to allow said beam to be rotated to its maximum angle to one side of the grader frame and having a length greater than half the width of the frame. The intermediate arm slopes downwardly and outwardly from the end of the central arm and of a length greater than the depth of the frame adjacent the blade positioning apparatus. The distal arm extends upwardly and outwardly from the intermediate arm to form an approximate "W" shaped beam. The link member is removably fastened to and reinforces the beam member at the junction of said distal and intermediate arms. The apparatus being such that one of said intermediate arms lies adjacent the frame when said beam is fully rotated to its maximum position.

According to an aspect of the invention, a unique locking mechanism is disclosed comprising a lock bar pivoted at one end of the lower surface of the grader frame for movement from a locked position to a clear position and a link member is provided having a plurality of notches for receiving the lock bar and thereby securing the beam at various adjusted positions. Means for moving and maintaining the lock bar in the desired position are provided and the structure further includes guide support means for transmitting forces applied to the lock bar by the link member to the grader frame.

According to a further aspect of the invention, the means for moving the free end portion of the lock bar includes an over-center spring biased bar linkage which can be adjusted from the cab of the grader by a mechanical linkage.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
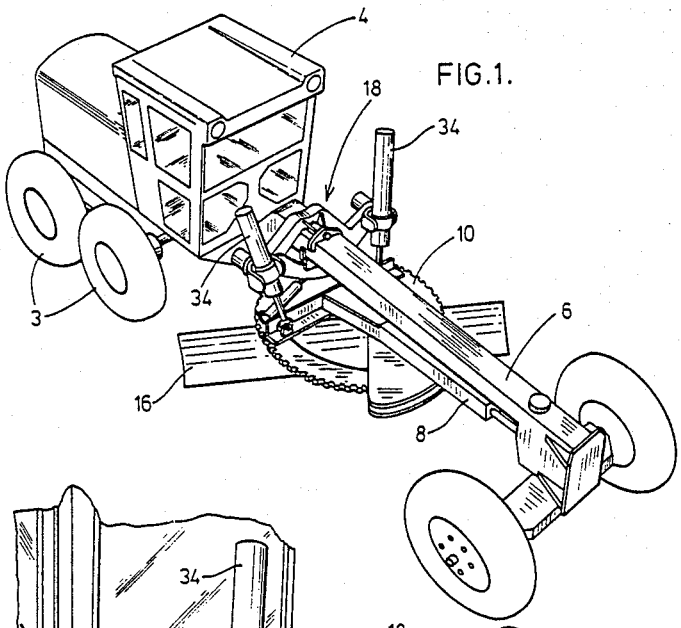
FIG. 1 is a perspective view of a grader and the blade positioning device.

The blade positioning apparatus is shown in FIG. 1 mounted on a motor grader. The motor grader has a support frame 6 from which the blade positioning apparatus, generally shown as 18, is supported. The motor grader has a motor 2, a cab 4, and a pair of tires 3 mounted on the aft portion of the support frame, and two front tires supported from the forward portion of the support frame. A draw bar 8 is swivellably secured to the nose portion of the support frame by a ball and socket joint, and rotatably supports the grader blade 16 in cooperation with the ring gear 10.

Figure 2:
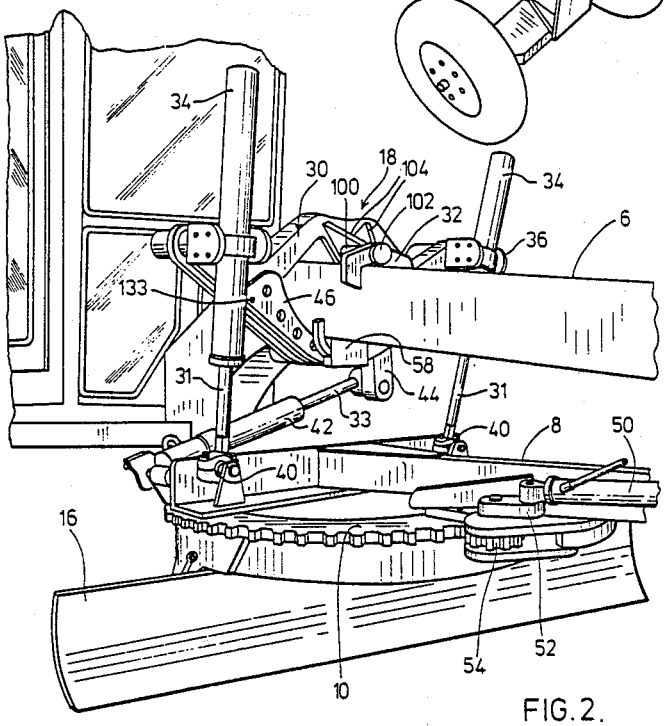
FIG. 2 is a perspective view of the blade positioning device of FIG. 1.

The blade positioning apparatus 18 is shown in greater detail in FIG. 2. It comprises a beam member 30 pivotally secured to the support frame by a bracket 32, located forward of the beam member, and a collar arrangement 120 (collar 120 best shown in FIG. 4) located aft of the beam member. Hydraulic lift cylinders 34 are universally secured to said beam by stirrup arrangements 36, which are supported at opposite ends of beam 30 and allow partial rotation of the cylinder in planes both parallel and perpendicular to the length of the beam. The rod extension 31 of each of these double acting hydraulic cylinders is secured to the ring gear 10 by a ball and socket joint 40. A double acting hydraulic shift cylinder 42 is secured at one side of ring gear 10 by a ball and socket joint with the rod extension 33 of the cylinder connected by a ball and socket joint to bracket 44 which is rigidly connected to the link member 46. Link member 46 passes beneath the support frame 6 and is removable secured to the beam member 30 by bolts 133 at points spacing the support frame.

A hydraulic cylinder 50 operates a crank arm 52 which rotates a gear 54 meshing with ring gear 10, causing the ring gear to rotate beneath the draw bar 8. A similar cranking arrangement is located on the opposite side of the draw bar which works in conjunction with this cranking system. This arrangement allows the length of the blade to be positioned at various angles with respect to the length of the draw bar.

A bracket 58 is located on the underside of the support frame forward of link member 46 and cooperates with the collar arrangement 120 to act as a guide for link member 46, during rotation of the beam and also to minimize movement of the link along the length of the support frame.

Figure 3:
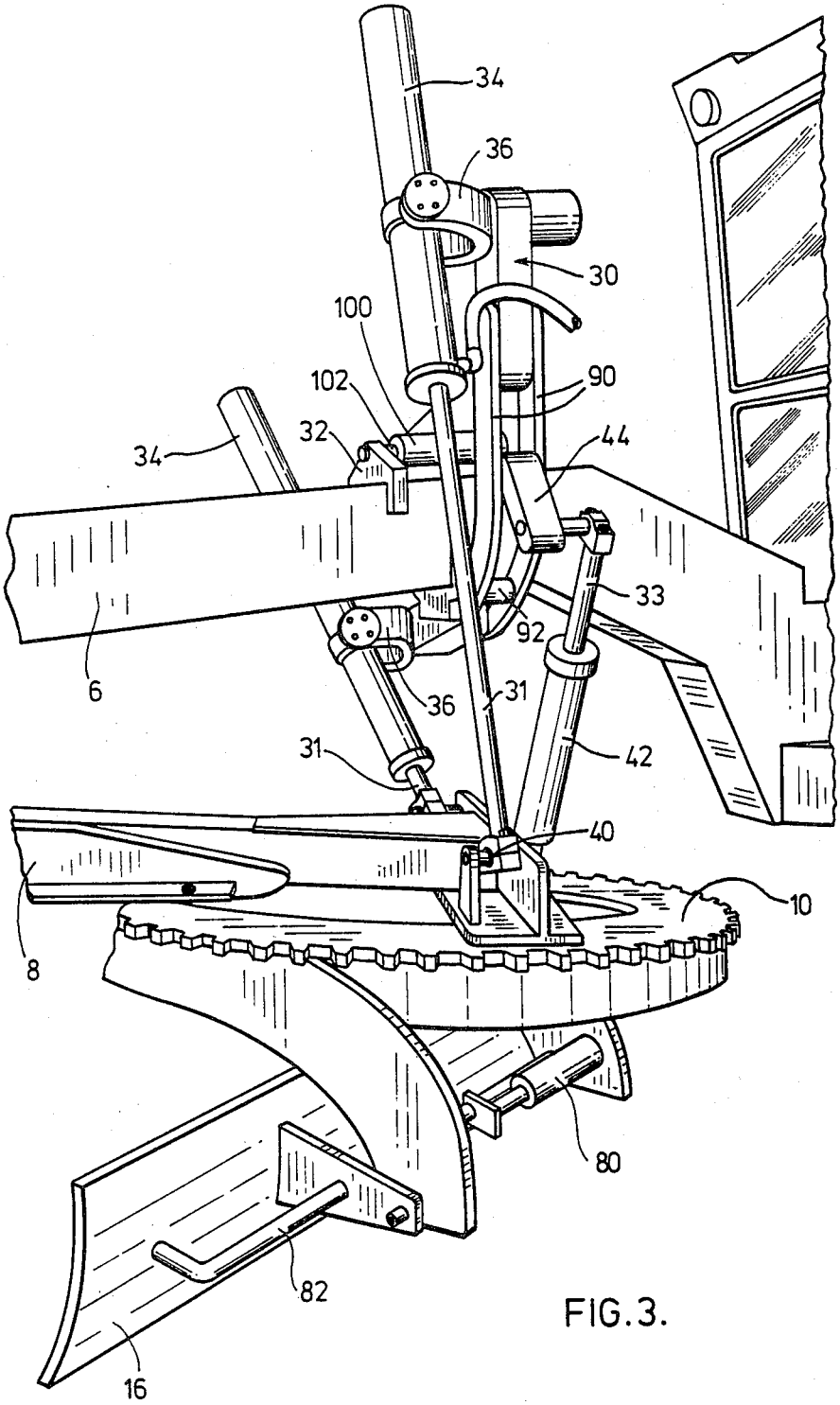
FIG. 3 is a perspective view of the blade positioning device with the ring gear shifted to one side of the grader.

As shown in FIG. 3, the blade is slidably supported beneath the ring gear and has a hydraulic cylinder 80 to slide the blade beneath the ring gear. A steel shaft 82 is secured to the grader blade 16 and acts as a guide for the sliding of the blade. Another hydraulic cylinder (not shown) is secured between the ring gear and the grader blade to rotate the blade about shaft 82, changing the cutting angle of the blade relative to the ground.

According to one embodiment, the link member 46 consists of two steel plates 90 which are removably secured to the beam member 30. The steel plates are spaced by the width of beam member 30 and are provided with a plurality of barrel portions 92 which also space the plate members 90. The barrel members 92 interact with a lock pin arrangement which will be discussed later.

With reference to FIGS. 2 and 3, the transverse beam member has a protruding bearing 100 rigidly secured to the beam, which sleeves the pin member 102. This pin member is secured to the support frame by bracket 32 and collar arrangement 120 spaced each side of the beam member. These components allow the beam member to rotate relative to the main frame of the grader, allowing the hydraulic cylinders to clear the support frame when the blade is positioned for extremely steep bank sloping. Triangular reinforcing brackets 104 are secured to the protruding barrel 100 and beam member 30 for reinforcing of this area.

FIGS. 2 through 8 illustrate how the blade positioning apparatus can be rotated about the support frame and positioned for very steep bank sloping. Although the drawings only show how the device can be adjusted in the extreme position to one side, one can readily appreciate the beam can be rotated and locked in any of the positions corresponding to the apertures 138, by a similar technique and the hydraulic cylinders adjusted to achieve the desired blade position.

The beam member 30 has to either side of the pivot axis a central arm portion 50, an intermediate arm portion 52 and a distal arm portion 54. The junction of said central arm portion has been provided with an aperture and bearing member to receive the pin member 102 and secure the beam to the support frame 6.

The particular shape of the beam member 30 is such that the operator's line of vision from within the cab 4 is improved in the area above the blade positioning device and either side of the device. As best shown in FIG. 2, the operator is positioned with his line of vision above the frame 6 and, therefore, it is important to ensure this area is as free from obstruction as possible. In this regard, the prior art systems, which use a four bar linkage arrangement with two crank arms positioned on either side of the grader, ensure this area is relatively free from obstruction; however, they accomplish this by providing a non-rigid structure which is more susceptible to wear and breakage.

Figure 4:
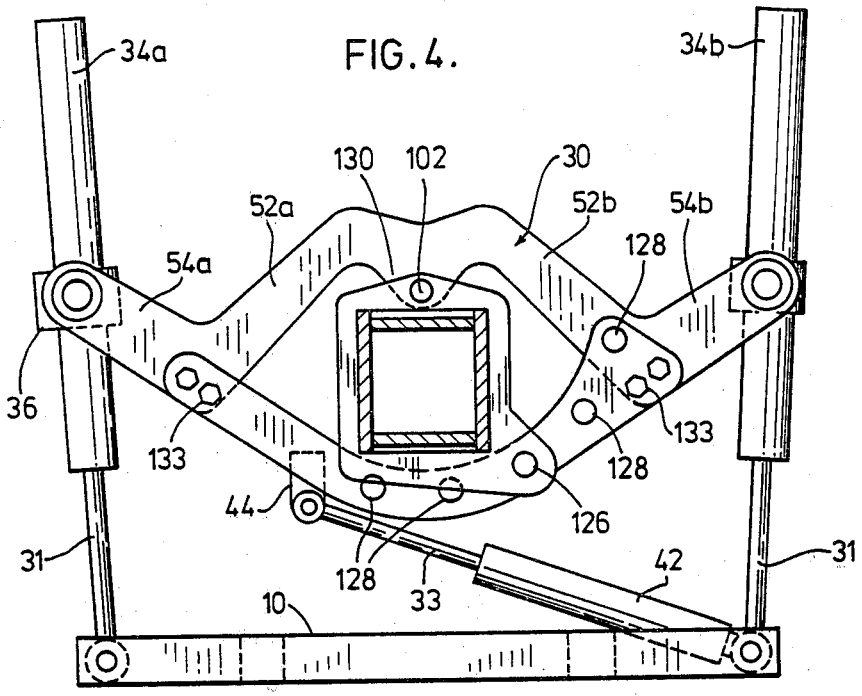
FIG. 4 is a cross-section of the blade positioning device looking forward with the transverse beam essentially horizontal.

The structure, as shown in FIG. 4, has been designed such that the pivot point is directly above the frame and the central arms project upwardly and outwardly to allow the beam to be rotated. The intermediate arm portions project downwardly and outwardly from the central arms to provide a larger clear viewing area adjacent the upper surface of the frame when positioned as shown in FIG. 4. Therefore, the particular shape and orientation of the central and intermediate arm portions provides a larger clear viewing area above the frame while still providing the inherent benefits of a rigid structure. The distal arm portions 54 extend upwardly and outwardly from intermediate arm portions 52 to support the hydraulic lift cylinders 34*a*and 36*b*, such that the stirrup connections are approximately at the same level as the pivot pin 102. The positioning of the distal arms does obstruct the viewing area somewhat; however, this particular relationship is desirable for lifting and rotation criteria and the detrimental ffect of the location of these arms is not substantial as it occurs at a distance spaced from the frame and only limits, to a slight degree, the peripheral vision of the operator.

Although in normal use the beam 30 will be positioned generally horizontally, on occasion it may be necessary to rotate the beam to achieve a particular cutting angle for the blade 16. The particular shape of the beam and the various positions it can be positioned in, allow the blade to be rotated from a horizontal to vertical position while still providing a clear viewing area above. The beam is shown in an extreme position to one side of the frame in FIG. 5 and the intermediate arm portion 52*b* is generally at approximately 90° relative to the side of the grader frame. The distal arm portion 54*b* is extending generally upward and, although it does impede a portion of the viewing area, the decrease is minimal as it is spaced from the grader frame. Also the viewing area to the other side of the frame has increased as intermediate arm portion 52*a* is abutting the frame and distal arm portion 54*a* is now below the grader frame.

Figure 5:
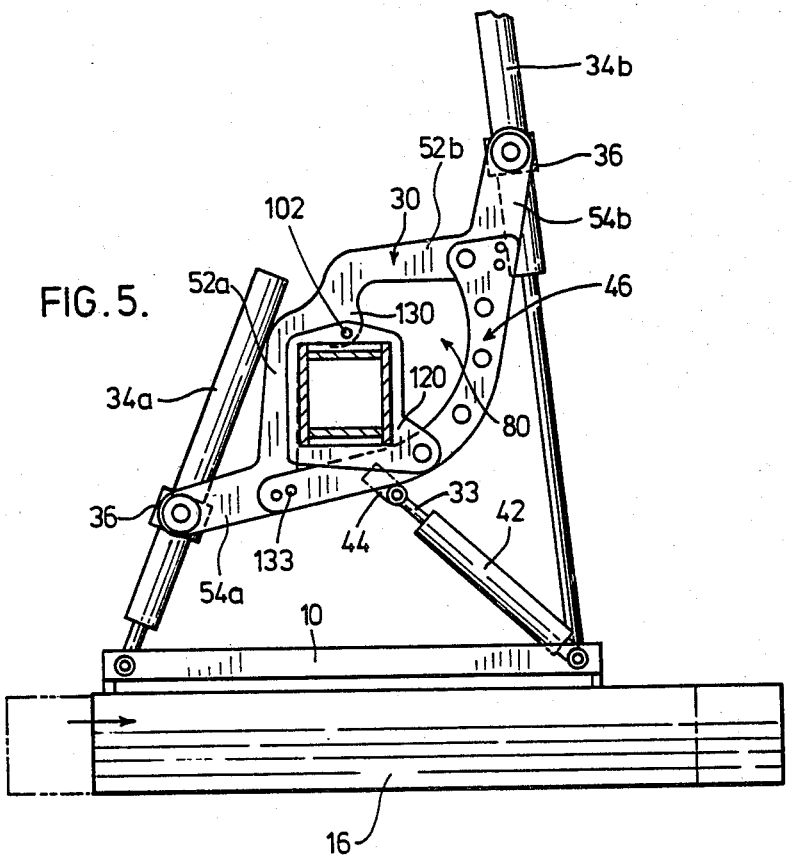
FIG. 5 shows the same view as FIG. 4; however, the transverse beam has been rotated relative to the frame.

A number of prior art devices have suggested that large "viewing windows", such as the "window" 80 shown in FIG. 5, are valuable in improving viewing; however, according to the present invention, this "window" area is only present to allow rotation of the beam and link and, although some veiwing is possible through this "window", it is quite limited and, therefore, the present invention tends to minimize this area to maximize the viewable area ouside of the beam and link combination. To achieve this in addition to the unique beam configuration, the link member is generally arc-shaped to pass immediately beneath the frame In the structure shown, the beam is symmetrical with the central arms being at an angle of approximately 90° to one another and of a length greater than approximately half the width of the grader frame. The intermediate arm portions form an angle of approximately 90° with a respective central arm portion and are of a length greater than the depth of the frame. The distal arm portions define an angle of approximately 90° or greater with the intermediate arm portion and the stirrup connections and the pivot pin are generally colinear, such that the stirrup connections are generally at the same height as the pivot pin when the beam is adjusted, as shown in FIG. 4.

As shown in FIG. 4, the collar member 120 has an enlarged portion located to one side of the support frame and slightly below the support frame which is adapted to slidably secure lock pin 126. This protruding portion of the collar 120 has been reinforced with a barrel member 124 which acts as a guide for the lock pin allowing the lock pin to engage the selected circular aperture in the link member 46 or allow the lock pin to be withdrawn freeing the beam for rotation. The apertures 128 have been spaced in a link member such that the beam can rotate through approximately 270° from an angle of aproximately 45° relative to the upper surface of the support frame, one side of the grader to the same angle on the other side of the grader and locked at various fixed angles, allowing the blade to be positioned either side of the grader for road grading or extreme bank sloping. FIG. 4 also illustrates how the link member 46 is removably secured to the beam member 36 by bolt members 133 at positions spaced each side of the support frame. The link member 40 has an arced shape to assure the beam can rotate relative to the main frame.

Figure 9:
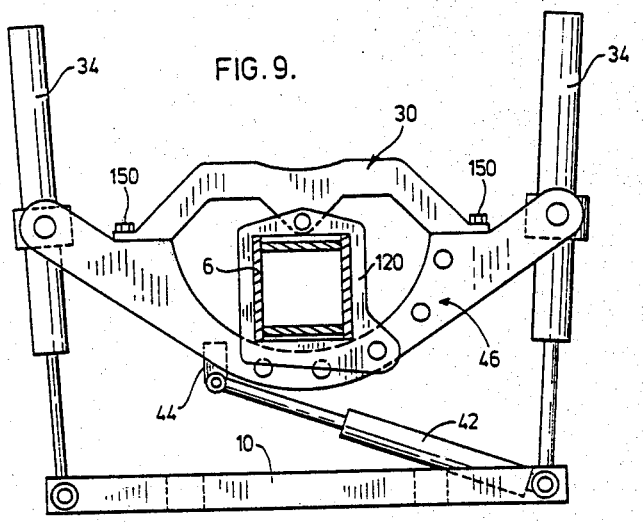
FIG. 9 is a front view of an alternative embodiment of the blade positioning device.
Figure 10:
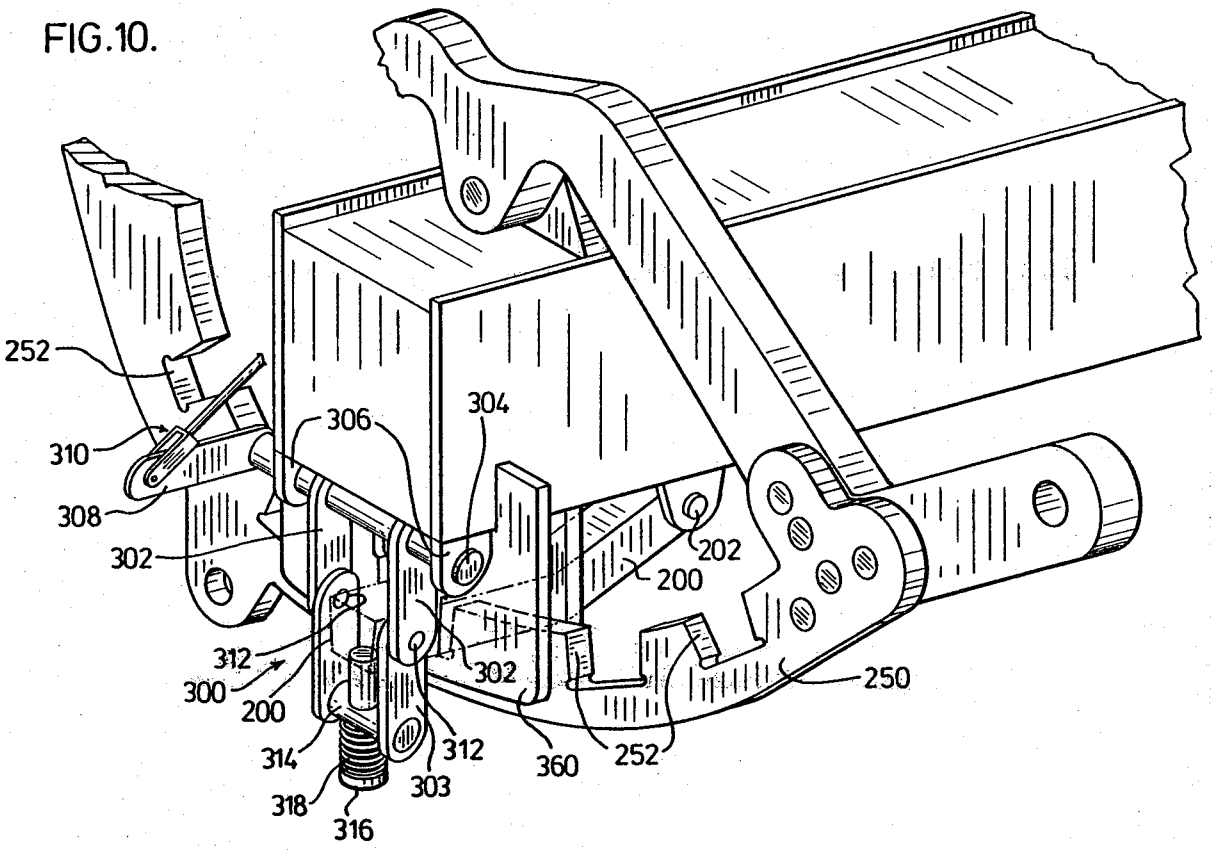
FIG. 10 is a partial perspective of the blade positioning device provided with an alternative method of locking the device.
Figure 11:
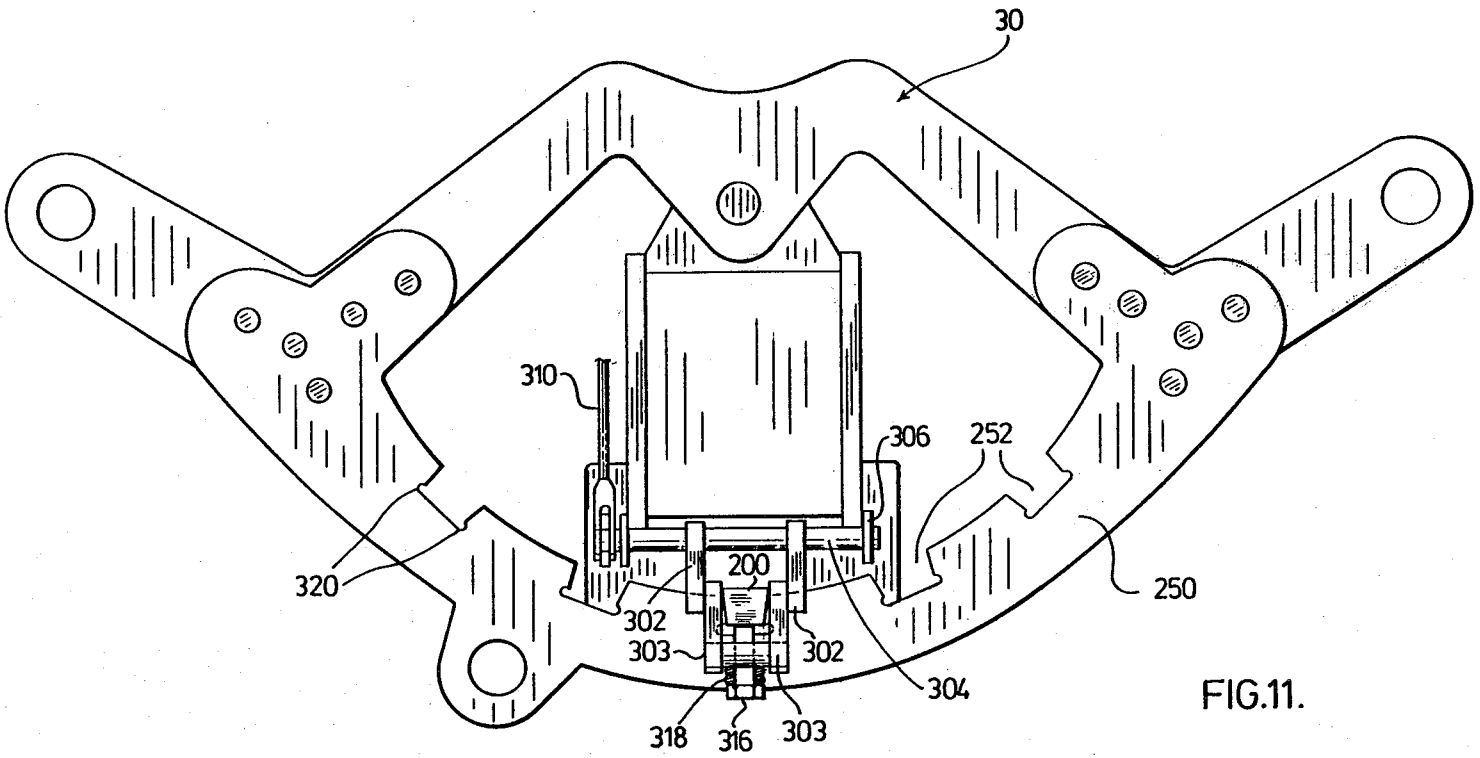
FIG. 11 is a rear view of the alternate structure for locking the device.

The combination of the beam member 30 and the link member 46 encircles the support frame; is rotatably supported by the support frame; is capable of locking in selected positions and is adapted to support the double acting hydraulic lift cylinders 34. It is possible for the link member to be a solid piece and extend beyond the beam to support the connecting stirrup assemblies for the lift cylinders. In this case, the beam 30' would be removably secured to the link member by bolts 150 and terminate at the intersection of these members. The link member 46' would then extend to support the cylinders and form the previous distal arms of the beam member as shown in FIG. 9.

To rotate the beam from a position of road grading, as shown in FIG. 4, to the position shown in FIG. 5, the blade of the grader would be lowered to the ground by adjusting the hydraulic lift cylinders 34*a* and 34*b*. When the blade has been placed on the ground, the lock pin 126 is disengaged from the central aperture of the link member. This then releases the beam member and link member for rotation about pin 102. The beam member 30 can be rotated relative to the main frame by various adjustments of the hydraulic lift cylinders and the hydraulic shift cylinder.

Figure 7:
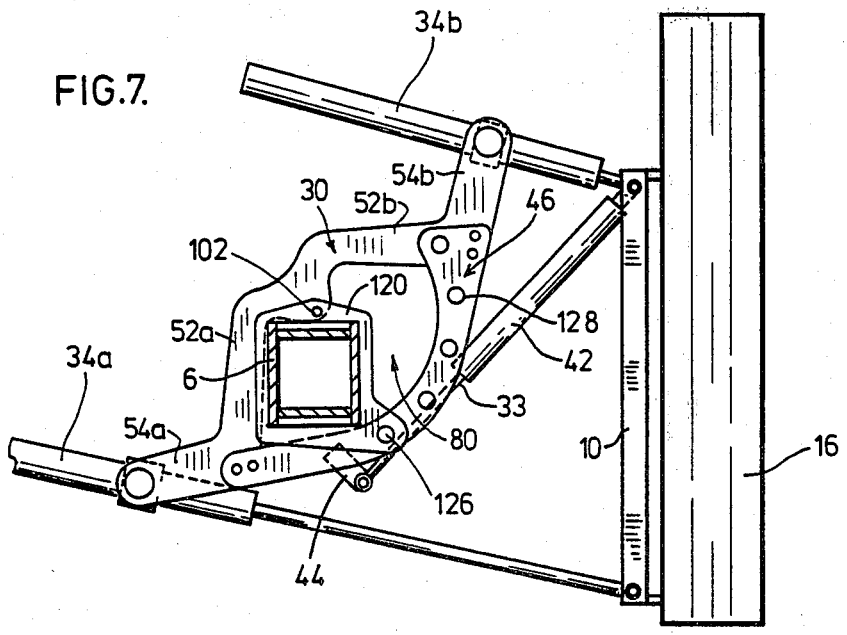
FIG. 7 shows the blade positioning device further adjusted to position the blade for very steep bank cutting.

One method of rotating the beam is accomplished by allowing the hydraulic lift cylinders to freely react to the adjustment of the shift cylinder. In this case, the shift cylinder would retract causing the beam to rotate, because the ring gear remains stationary as the blade is resting on the ground. The beam is rotated to align and engage the lock pin 126 with the selected aperture 128. As can be seen in FIG. 5, the hydraulic lift cylinder 34*a*has retracted and rotated about its stirrup connection, while 34*b* has extended and also rotates abouts its stirrup connection 36. The stirrup of cylinder 34*a*is now positioned below the support frame which allows the cylinder to clear the frame when the blade is positioned for extreme bank sloping, as shown in FIG. 7. It should be noted that the beam is pivotaly secured to the support frame at the junction 130 of the central arm portions 50 such that the pivot point is beneath the midpoint of the beam and the beam has sufficient clearance to rotate to the position shown without interferring with the frame.

Figure 6:
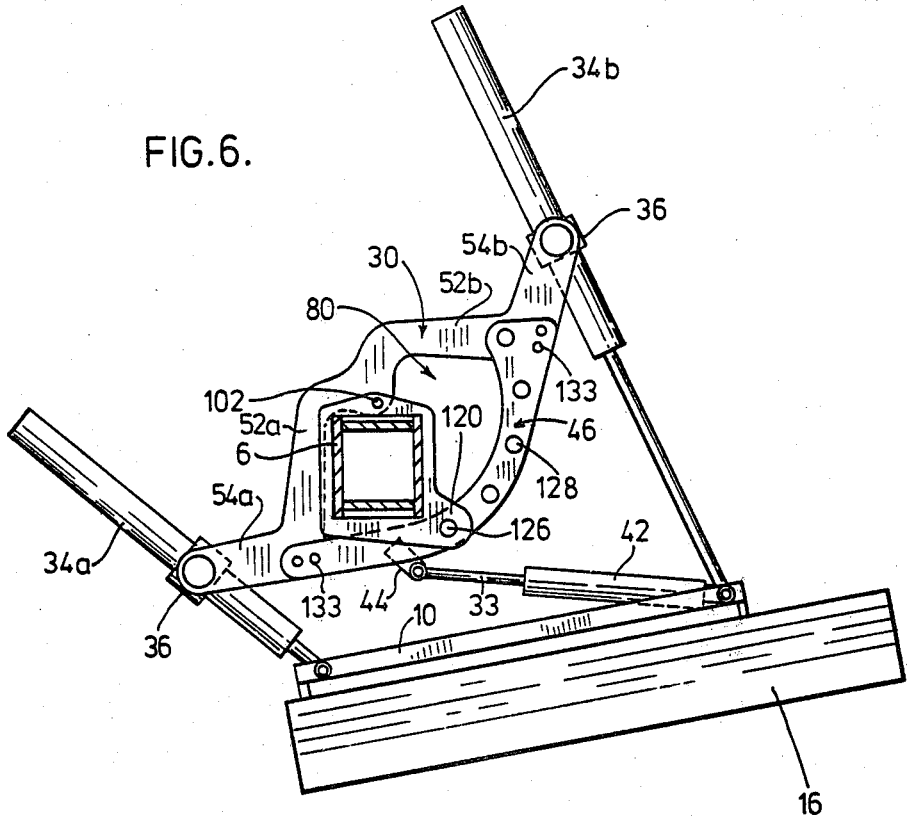
FIG. 6 shows the beam locked in the position shown in FIG. 5; however, the hydraulic cylinders have been adjusted to change the position of the blade.

In FIG. 6, the lock pin 126 has been secured in the end aperture and the hydraulic lift cylinders and the hydraulic shift cylinder are adjusted to position the blade at the desired angle for bank sloping. The shift cylinder 42 has extended and hydraulic cylinder 34*b* has retracted slightly. It is through the combined adjustment of the three hydraulic cylinders and the locked transverse beam member that the blade can be selectively positioned.

As seen in FIG. 7, the hydraulic shift cylinder 42 has continued to extend, hydraulic lift cylinder 34*b* has continued to retract and hydraulic lift cylinder 34*a* has been extended such that the ring gear and blade have been rotated to a position essentially parallel to the side walls of the main frame. In this position, the blade could scrape a vertical wall, if the grader was on a horizontal surface.

From FIG. 6, it is apparent that various angles of bank sloping could be accomplished; however, it has been found that this setting is particularly useful for sloping banks of an angle between 45° to 90°, and the intermediate apertures are useful for road grading and bank sloping up to approximately 45°. The central aperture is useful for road grading and a limited amount of sloping. This portion is also useful for sloping the blade to correspond to a crowned road or cutting a shallow ditch. This can be accomplished by extending the hydraulic lift cylinder on the side of the ditch and adjusting the side shift cylinder appropriately.

The draw bar of the grader is designed to advance the blade with the foward movement of the grader and allows the blade to be positioned either side of the support frame. Because the draw bar is attached to the nose of the grader with a swivel connection, the ring gear and blade can also be rotated. The shit cylinder 42 essentially positions and maintains the blade either side of the grader while the hydraulic lift cylinders control the elevation and angle of the blade relative to the ground. It is readily apparent that the hydraulic lift cylinders and hydraulic shift cylinder all cooperate to achieve the desired results.

The various forces applied to the blade by the surface being graded or sloped are transmitted to the draw bar and to the blade positioning device. The beam member 30, when locked, is essentially rigid with the support frame and has forces transmitted to it by the hydraulic lift cylinders and the hydraulic shift cylinder. The beam 30 and link member 46 are only slightly loaded in the fore/aft position of the grader with the largest forces being exerted in the plane generally perpendicular to the length of the support frame. When in use, the link member and beam are locked to the support frame and are loaded at the stirrup connections 36 and at bracket 44 connecting the shift cylinder to the link member.

Figure 8:
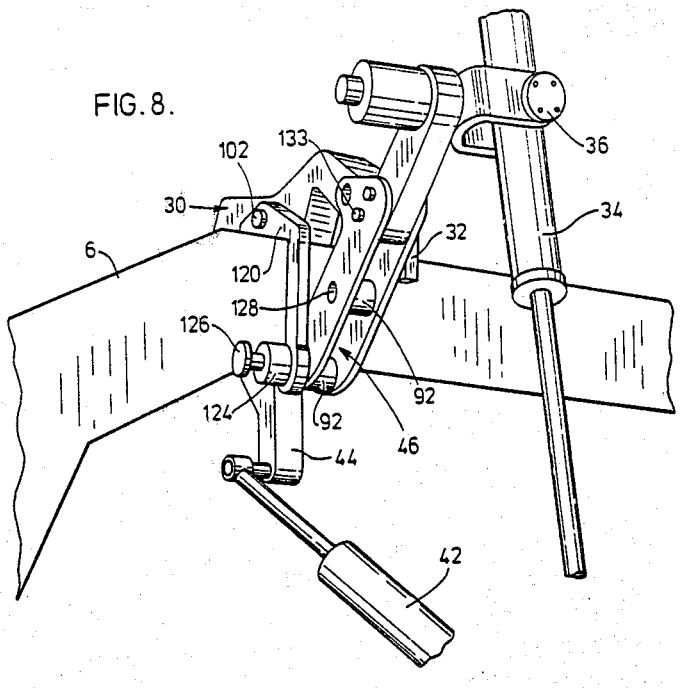
FIG. 8 is a perspective view of the blade positioning apparatus from one side of the grader.

Referring to FIG. 8, the resultant force and moment is opposed by the pin member 102 and the lock pin 126, when the lock pin engages the link member 46 and barrel member 92. The moment applied to the beam combined with the distance between pin 102 and lock pin 126 determines the forces exerted on the pins. As the distance between the pins is increased, the forces are reduced. This invention has maximized this distance as much as possible without unduly increasing the moment exerted on the support frame by the collar arrangement 120 and bracket 32.

The lock pin, as shown in FIG. 8, is not fully engaging the reinforcing barrel member 92. It can be appreciated that the reinforcement barrel member has a hollow cylinder portion for snuggly receiving the lock pin 106. The position of the lock pin and the pin member 102 close to the main frame of the grader, yet spaced from each other, has allowed the forces exerted on these members to be minimized, while allowing the beam rotation design to remain simple resulting in a system that can be manufactured easily from rugged components.

As previously mentioned, there may be a slight loading of the beam member and link member in the fore-aft direction of the grader; however, the collar arrangement 120, bracket 32 and guide plate 58 distribute these loads to the support frame.

A different type of locking arrangement is shown in FIGS. 10 through 13 which uses a pivoted lock bar 200 in combination with a modified link member 250. The lock bar 200 is pivoted to the lower frame of the grader by pin member 202, such that the lock bar can engage one of a plurality of notches 252 provided in the link member, or be moved to a position clear of said notch members beneath the frame of the grader such that the beam and link member may be moved to a different locking position. As can be seen in these Figures, the lock bar is pivoted in front of the blade positioning apparatus and extends rearwardly between the link member and the frame of the grader. A linkage arrangement 300 is located at the free end of the bar lock 200 for moving the bar lock from a locked position fully engaged in one of the notches 252 to a position clear of the link member 250 immediately beneath the frame of the grader. The linkage arrangement includes a pair of first link members 302, welded to an axle 304 pivotally secured beneath the frame of the grader 6 by bracket members 306. At one end of the axle member is a positioning arm 308 which can be moved by a linkage or cable arrangement 310 from the cab of the grader. A second set of link members 303 are pivotally secured to the first link members at position 312 and the opposite ends of said second links are connected by an axle member 314. Passing through the center of the axle member 314 is bolt member 316 which threadedly engages the bar lock. Associated with the bolt member 316 is die spring 318 which acts to compensate for variations in the size of notch members 252 and to allow linkage arrangement to pass through its fully extended position to an overcenter position and for maintaining the linkage in this overcenter position.

Each of the notch members 252 has been provided with tapered side walls opening upwardly at an angle of approximately 8° and the bar lock is similarly tapered for engaging the notches. This particular arrangement simplifies the positioning of the link member for receiving the bar lock, as the lower surface of the bar lock is narrower than the mouth of each notch and, therefore, the movement of the bar lock down into the notch provides a camming action and urges the link and beam to move to the precise location. Furthermore, the loer portion of each notch has been provided with a small radius portion 320 which defines an area at the base of the notch greater than the width of the portion of the notch immediately above, thereby assuring the lock bar fully contacts the notch and does not bottom out against the bottom of the notch. As can be appreciated with components of this type, in which high loads can be encountered and variations between individual notches may be present, it is valuable to provide a simple system which is not sensitive to these types of variations.

Figure 12:
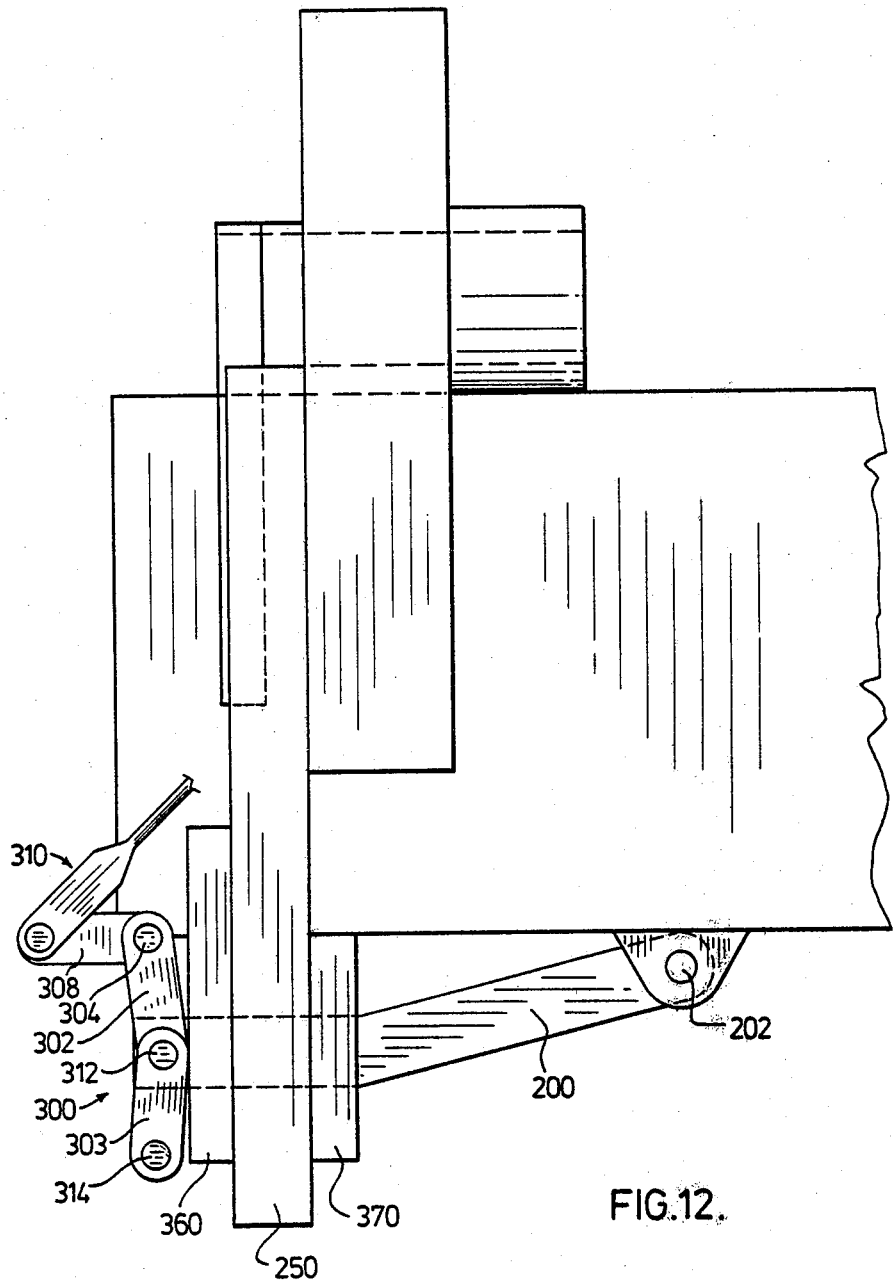
FIG. 12 is a side view of the alternate method of locking the device with the bar linkage shown in an overcenter position.

The present system, due to the particular method of engagement of the tapered bar within the tapered notches and the presence of the compensation spring 318, result in a system that ensures positive abutting contact of the bar lock with each notch without creating problems when the system is to be released. Therefore, the requirement for highly accurate tolerances is not as critical with this type of structure, thus simplifying the manufacturing of the link. It has been found that with this particular lock arrangement, the link member may be cut from a piece of plate steel and secured at one side of the beam member 30. Furthermore, in most circumstances, the notches 252 may also be cut from the link and do not require high accurate machine finishing techniques. If one notch is slightly larger or smaller, the lock bar will proceed until abutting contact is made and, at this point, subsequent movement of the linkage arrangement causes further compression of spring member 318, allowing the linkage arrangement to pass through its center point and lock in an over-center position. The over-center locking position is shown in FIG. 12 where it can be seen that both link members 302 and 303 have moved past their fully extended position, shown in FIG. 10 and now abut guide support member 360. As spring member 318 will be in a compressed state, the compression force in the spring assures that the linkage remains locked. Support member 360, in combination with support member 370, are shaped to allow bar lock 200 to move in the vertical plane and support the bar lock against movement in the horizontal plane. These members also act as guide members to assure the link member 250 does not move in the fore-/aft direction of the grader.

Figure 13:
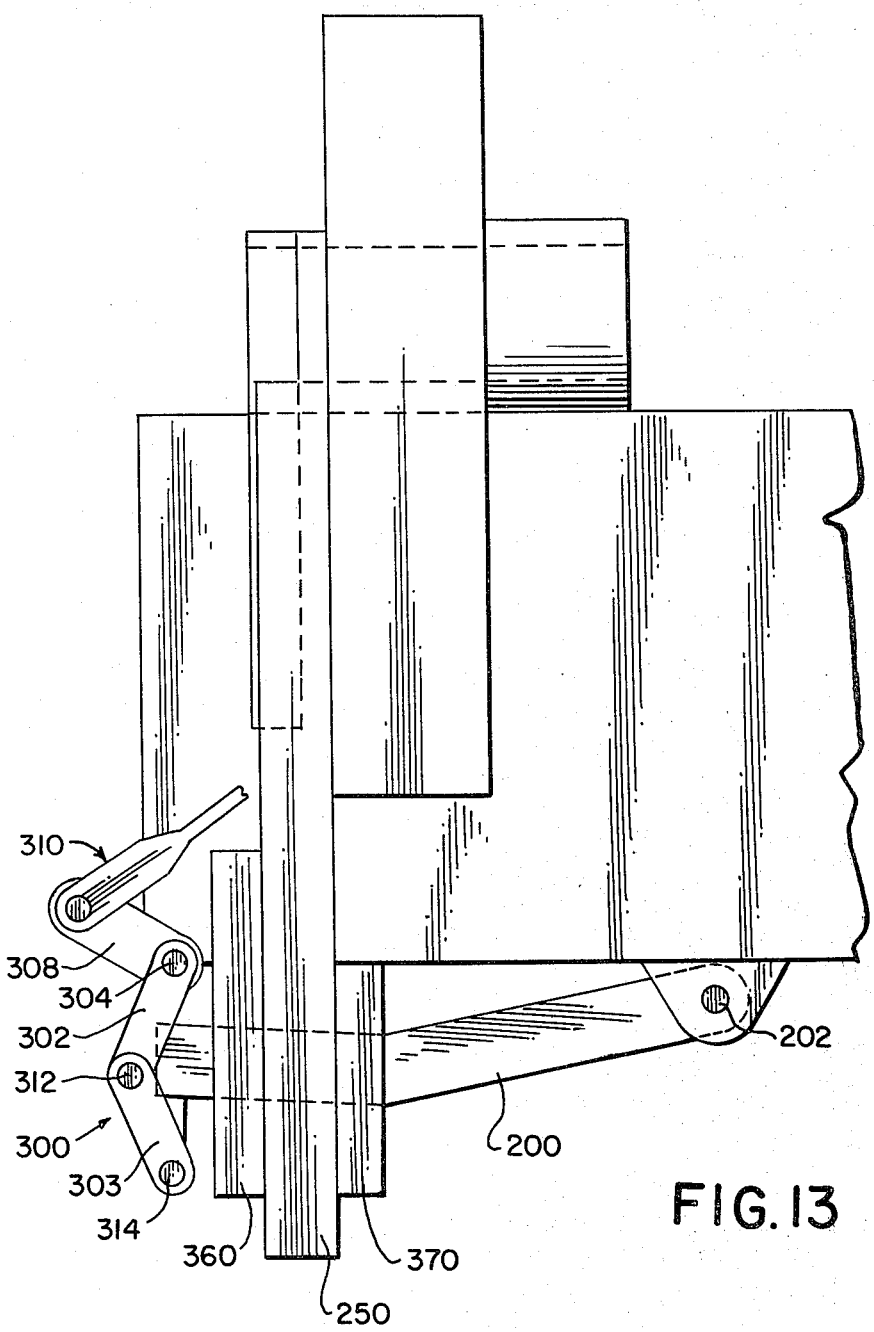
FIG. 13 is a side view of the alternate method of locking the device with the bar linkage being adjusted to position the bar lock in the unlocked position.

As can be seen in FIG. 13, the linkage arrangement has been moved through the fully extended position and is starting to lift the bar lock towards a fully clear position immediately beneath the frame of the grader. To simplify the movement of the bar lock, the respective locations of guide members 360, 370, the location of the link member 250, and the location of the notches 252, the bar lock is bent at an angle of approximately 15°, such that in the locked position, the end portion passing through the guide members 360, 370 and the link member is approximately horizontal, thus facilitating alignment and positioning of these components.

Thus, the link member 250 has been adapted to lock the link and beam member at the various adjusted positions and extends outwardly to the junction of the intermediate and distal arm portions for securement and to reinforce this area. It is readily apparent that this particular type of locking mechanism is more versatile than the commonly used pin and aperture arrangement and is not as sensitive to wear and variation in tolerances of the lock receiving apertures. Furthermore, with this type of system, use of hydraulic cylinders to position the bar lock is not required and a simple mechanical linkage to the cab may be used.

A motor grader usually has a long life and is built to be structurally strong. However, a blade positioning system that is subject to the forces caused by grading and the higher shock loads caused by a buried rock or sudden change in soil type, may eventually cause wear or fail. It is an important feature of this invention that the parts most vulnerable to wear are easily replaceable, these being pin 102 and lock pin 126 or bar lock 200, resulting in minimal downtime and minimal repair cost, if replacement is required. If the beam member 30 or link member 46 fail, they can also be replaced by removing bolts 133, disconnecting the link member and, if the beam has failed, then pin 102 must be removed and a new beam installed. This blade positioning system provides a rigid beam and link member that concentrates any wear in easily replaceable parts, while minimizing the forces exerted on these members causing the wear. It also allows major repairs in the field to be completed with minimal problems or expense and provides a system that is easily manufactured, without the need for extensive machining. Furthermore, the device greatly increases visibility above the frame of the grader and to the exterior of the device due to the unique shape of the beam.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In a motor grader having a support frame, a draw bar swivelled thereto adjacent its forward end and a scraper blade rotatably supported from said draw bar, a beam member transversing and centered on the top of said support frame and centrally pivoted to rotate about an axis extending in the fore and aft direction of the grader and secured to the upper surface of said support frame to adjusted positions, a link member removably fastened to said beam at points spaced at each side of said support frame such that said link and said beam encircle said support frame, the combination of said beam and said link member universally supporting outwardly to each side of said support frame a pair of hydraulically actuated lift cylinders, each cylinder extending downwardly to and universally connected to said draw bar, a double acting hydraulically actuated shift cylinder universally connecting the combination of said beam member and said link member to said draw bar for moving the aft portion of said draw bar to either side of said frame, an improved lock mechanism secured adjacent the lower surface of the grader frame for holding the combination of said beam member and said link member in selected adjusted positions and allowing the combination to be rotated to various adjusted positions when released, comprising a lock bar pivoted at one end to the lower surface of said frame for movement from a lock position to a clear position, said link member including a plurality of notches for receiving said lock bar and securing said beam at various adjusted positions, means for moving and maintaining said lock bar in the desired position and further including guide support means for transmitting forces applied to said bar lock by said link member to the grader frame, wherein said means for moving and maintaining said bar lock includes a bar linkage comprising a first link pivotally connected to said frame and a second link pivotally connected to said first link, and the opposite end of said second link secured to the free end of said bar lock, said linkage further including compensation means for allowing said linkage to pass through its fully extended position to an over-center position while still providing abutting contact of said bar lock in one of said notches in the over-center position and further including stop means for limiting the movement of said links after they have been passed through the over-center position.

2. In a motor grader as claimed in claim 1, wherein said compensation means further exerts a force on said linkage for maintaining the same in the over-center position.

3. In a motor grader as claimed in claim 2, wherein said compensation means comprises a spring, an axle and a bolt connector, said bolt connector passing through said axle and threadedly secured to the free end of said bar lock, said axle being connected to the lower end of said second link and said spring being under compression, spacing the head of said bolt and said axle and allowing said linkage to pass through the fully extended positions.

4. In a motor grader having a support frame, a draw bar swivelled thereto adjacent its forward end and a scraper blade rotatably supported from said draw bar, a beam member transversing and centered on the top of said support frame and centrally pivoted to rotate about an axis extending in the fore and aft direction of the grader and secured to the upper surface of said support frame to adjusted positions, a link member removably fastened to said beam at points spaced at each side of said support frame such that said link and said beam encircle said support frame, the combination of said beam and said link member universally supporting outwardly to each side of said support frame a pair of hydraulically actuated lift cylinders, each cylinder extending downwardly to and universally connected to said draw bar, a double acting hydraulically actuated shift cylinder universally connecting the combination of said beam member and said link member to said draw bar for moving the aft portion of said draw bar to either side of said frame, an improved lock mechanism secured adjacent the lower surface of the grader frame for holding the combination of said beam member and said link member in selected adjusted positions and allowing the combination to be rotated to various adjusted positions when released, comprising a lock bar pivoted at one end to the lower surface of said frame for movement from a lock position to a clear position, said link member including a plurality of notches for receiving said lock bar and securing said beam at various adjusted positions, means for moving and maintaining said lock bar in the desired position and further including guide support means for transmitting forces applied to said bar lock by said link member to the grader frame, wherein said means for moving and maintaining said bar lock includes a bar linkage comprising a first axle pivotally secured beneath the lower surface of the frame with a positioning arm secured near one end for rotating said axle and two link members secured to said axle generally above and to either side of said bar lock, a second set of link members pivotally secured to respective axle link members and a pivotally connected lower axle member passing through their free ends, said lower axle located below said bar lock and connected thereto by a bolt member passing through said lower axle, the head of said bolt member extending below said lower axle and having a compression spring member spacing said bolt and said lower axle, the arrangement being such that said bar lock may be positioned in either the lock or clear position by moving said positioning arm, said bar lock being fully received in one of said notches prior to said linkage being fully extended and said spring member allowing said linkage to pass through the fully extended position and lock at an over-center position.

5. In a motor grader as claimed in claim 4, wherein the axis of said first axle, the pivot connection between said first link member and said second link member, and the connection of said bolt member to said bar lock generally vertically align when said linkage is fully extended.

6. In a motor grader as claimed in claims 1, 2 or 3, wherein said bar lock is bent such that the free end thereof is generally parallel to the lower surface of said frame when in the locked position.

7. In a motor grader having a rectangular in cross-section frame supported on wheels including an earth moving blade support structure pivotally secured at one end to said frame and adapted to be raised, lowered or elevated to a high bank sloping position to either side of said frame, a blade positioning apparatus comprising a generally "W" shaped arm extending laterally of said frame, said arm being pivotally disposed above said frame on an axle member affixed longitudinally to the upper side of said frame, a pair of double acting cylinders each being pivotally connected to said arm at opposite ends thereof, an arcuately shaped cross member adapted to laterally traverse below said frame, said cross member being removably bolted at opposite ends thereof to the lower portions of said "W" shaped arm, a third cylinder pivotally connected to a downwardly extending portion of said arcuately shaped cross member, the opposite ends of each cylinder being pivotally connected to a laterally disposed rearward portion of said earth moving blade support structure, said arcuately shaped cross member having a series of inwardly tapering, spaced-apart notches in the upper surface thereof, a tapered in cross-section rectangular latch member located longitudinally under said frame and pivotally attached to said frame at one end, said latch member including a spring-loaded, over-center linkage whereby, when said latch member is engaged in any one of said corresponding notches in said arcuately shaped cross member, said latch member is held securely latched under heavy loads.

8. In a motor grader as claimed in claim 7, wherein a pair of guide members are affixed below said frame and extend downwardly at opposite sides and in sliding relation to said arcuately shaped cross member, said guide members each having a rectangular opening therein for slidably engaging said rectangular latch.

* * * * *